US005358384A

United States Patent [19]

Dysarz

[11] Patent Number: 5,358,384

[45] Date of Patent: Oct. 25, 1994

[54] DEVICE AND METHOD TO RELIEVE CORDELLE ACTION IN A CHAIN DRIVEN PUMP

[76] Inventor: Edward D. Dysarz, 11423 Triola La., Houston, Tex. 77072

[21] Appl. No.: 55,542

[22] Filed: May 3, 1993

[51] Int. Cl.[5] ..... F04B 21/04

[52] U.S. Cl. ..... 417/555.2; 166/369; 166/68.5; 74/89.21; 474/111; 474/140

[58] Field of Search ..... 417/555.2; 166/369, 166/68.5; 74/89.21; 474/111, 140

[56] References Cited

U.S. PATENT DOCUMENTS

| | | | |
|---|---|---|---|
| 4,063,825 | 12/1977 | Cardoneau | 417/34.3 |
| 4,179,947 | 12/1979 | James | 74/89.2 |
| 4,197,766 | 4/1980 | James | 74/611 |
| 4,404,863 | 9/1983 | James | 74/89.2 |
| 4,676,311 | 6/1987 | Dysarz | 166/68.5 |
| 4,714,110 | 12/1987 | Dysarz | 166/68 |

*Primary Examiner*—Richard E. Gluck
*Assistant Examiner*—Alfred Basichas
*Attorney, Agent, or Firm*—Derek R. Van Gilder

[57] ABSTRACT

A cordelle action relief apparatus or device for use in sucker rod pumps in a petroleum or water well. The device is incorporated in a chain driven pump to prevent the chain from forming a bow or archlike configuration as the chain rolls off of the sprocket and down into the well. When the chain is allowed to form this bow or arch it could damage the well and well casing. The device includes a first rod on the side of the chain and a second rod on the second side of the chain that will allow the rollers of the chain to roll on the rod and further prevent the chain from bowing or arching and will further allow the rollers on the chain to roll on the rods which will further prevent damage to the well casing, the well, and the chain.

15 Claims, 6 Drawing Sheets

DEVICE AND METHOD TO RELIEVE CORDELLE ACTION IN A CHAIN DRIVEN PUMP

BACKGROUND OF THE INVENTION

The present invention relates to pumps that pump fluid out of the ground. More specifically the present invention relates to sucker rod pumps that pump petroleum or other minerals out of the earth. Even more specifically the present invention relates to sucker rod pumps wherein the sucker rod is fixed to a mechanical chain that operates in a pipe or tube. The present invention has been found to be particularly useful in offshore petroleum wells and subsea petroleum wells.

DESCRIPTIONS OF PRIOR ART

There are a number of petroleum pumps that use chains that are fixed to the sucker rods such as James U.S. Pat. No. 4,534,706, James U.S. Pat. No. 4,179,947, Cardoneau at al U.S. Pat. No. 4,063,825, Dysarz U.S. Pat. No. 4,676,311, and Dysarz U.S. Pat. No. 4,714,110. All of these inventions teach the use of sucker rods that are fixed to mechanical chains and wherein the mechanical chains are bent over sprockets as they move the sucker rods up and down; they do not teach any means of eliminating the arch like configuration or cordelle action of the chain after it is moved off of the sprocket.

SUMMARY OF THE INVENTION

It is the object of this invention to provide a means to prevent a mechanical chain form forming an archlike configuration of cordelle action as it rolls off of a sprocket in a petroleum well thus preventing the chain from being damaged or preventing the chain from damaging various components within the petroleum well.

It is another object of the present invention to provide an improved means of preventing sucker rod torque from twisting the mechanical chain and further causing the mechanical chain from twisting off of the sprocket.

It is still another object of the present invention to allow a down hole stuffing box to be tightened or adjusted below the wellhead or ground level while the pump is operating.

The foregoing and other objects and advantages of the invention are attained by a first rod located near the sprocket and the mechanical chain and a second rod located essentially below the sprocket and on the second side of the mechanical chain wherein the rollers of the mechanical chain roll or rub on the first rod as the mechanical chain rolls off of the sprocket and wherein the mechanical chain is prevented from forming an arc as it rolls off of the sprocket and further the rollers of the mechanical chain may also roll on the second rod after they roll on the first rod, thus preventing a backlash of the mechanical chain. The coupling that fixes the mechanical to the polished rod or sucker rods will also have recesses formed on each side slightly greater than the size of the first and second rods which will partially surround the first rod and second thus acting as a guide for the mechanical chain thus preventing torque from the sucker rod and polished rod from reacting with the mechanical chain.

In accordance with another feature of the invention the first rod that is located near the sprocket and extends from the near top of the pump past the sprocket into the well where it is further fixed to a long small diameter pinion gear. The long small diameter pinion gear is further rotatably meshed with a short greater diameter pinion gear. The short greater diameter pinion gear is fixed to the top of a stuffing box compression tube. The stuffing box compression tube is threaded into the stuffing box and sits on top of the packing contained or held within the stuffing box. When the first rod is rotated with a wrench at the top end of the first rod, it rotates the long small diameter pinion gear which in turn rotates the short large diameter pinion gear that is fixed to the top of the stuffing box compression tube. The stuffing box compression tube is threaded into the stuffing box and when it is rotated the threads cause it to move downward and tighten the packing around the polished rod or sucker rod to prevent crude oil or other minerals from contaminating the chain and sprockets and to further prevent the loss of lube oil from the pump.

The feature of the present invention can best be understood together with further objects and advantages by referring to the following descriptions in connection with the accompanying drawings wherein like numerals indicate like parts.

DETAILED DESCRIPTION OF THE PREFERRED EMBODIMENT

Figure 1:
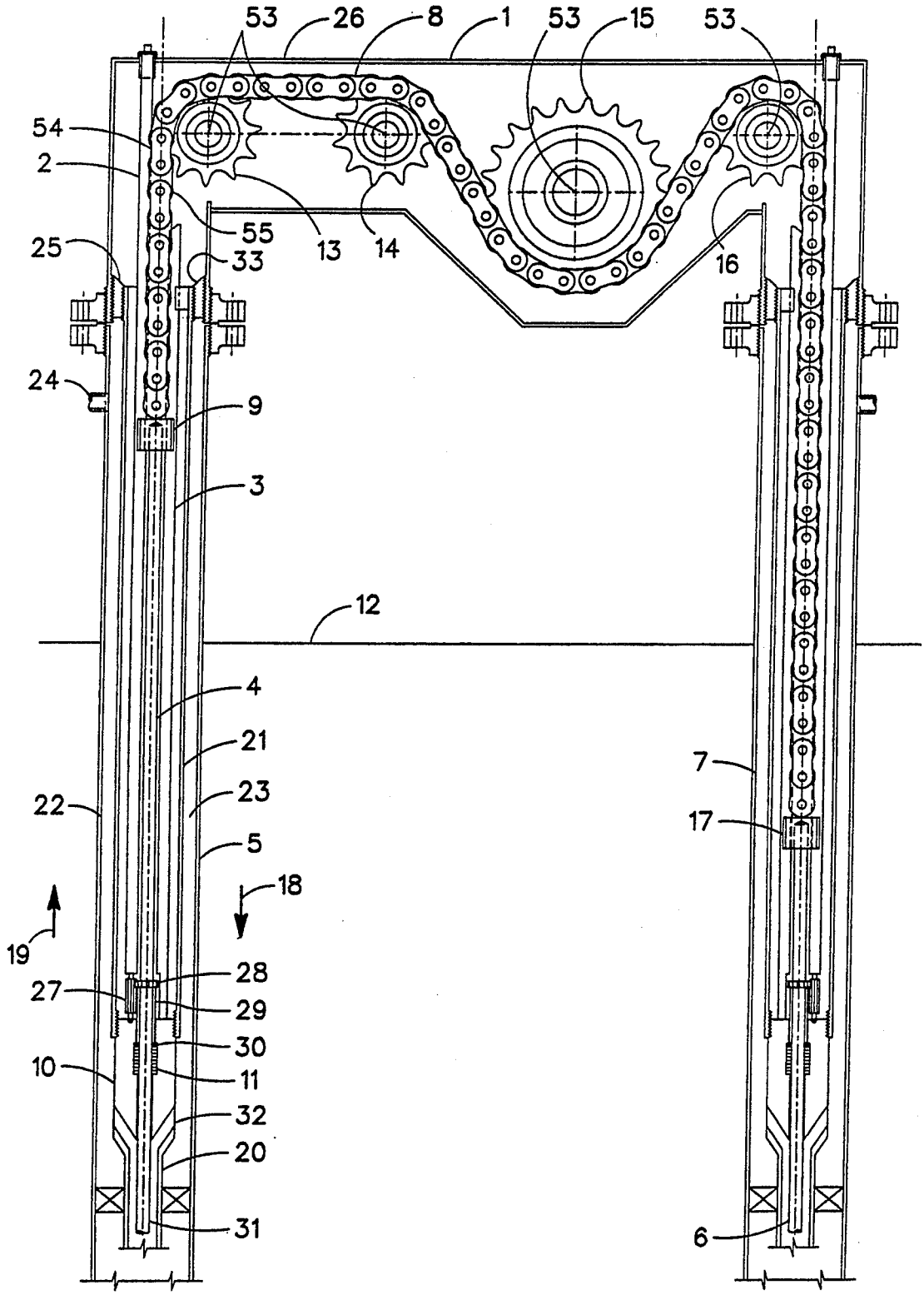
FIG. 1 is a section elevation view of the preferred embodiment showing all of the components of the pump.

Referring to FIG. 1 there is shown the apparatus or device on each side of a two well counter balanced pump 1.

The two well counter balanced pump 1 is a chain driven sucker rod pump and is shown as a long stroke pump that utilizes the weight of a left sucker string 4 of a left well 5 to offset the weight of the right sucker rod string 6 in the right well. The left sucker rod string 4 is shown suitably fastened to the mechanical chain 8 at the first end of the left sucker rod string 4 by a guide coupling 9. The left sucker rod string 4 is further shown extending through the left stuffing box 10 and though the gland 11 toward the second end of the left sucker rod string 4, wherein the second end of the left sucker rod string 4 extends into the earth 12.

As noted, the first end of the left sucker rod string 4 is fixed to the second end of the guide coupling 9 and the first end of the guide coupling 9 is further fixed to the second end of the mechanical chain 8. The mechanical chain 8 extends upward where it is bent around a first idler sprocket 13 and is further bent around a second idler sprocket 14 and is further bent around a drive sprocket 15 and is further bent around a third idler sprocket 16, where it extends downward into a right well 7. The first idler sprocket 13, the second idler sprocket 14, the drive sprocket 15, and the third idler sprocket all rotate around a sprocket axis 53 that is in the center of each sprocket. The mechanical chain 8 is further shown fixed to a second guide coupling 17 at the second end of the mechanical chain 8. The second guide coupling 17 is further shown fixed to the right sucker rod string 6 that further extends down into a right well 7. For the purposes of specification, the right sucker rod string 6 could either be in an active well or just a counter weight in a counter weight well.

To operate this type of pump 1 the drive sprocket 15 is rotated by a motor not shown, in a clockwise direction thus causing the left sucker rod string 4 to move in a downward 18 direction. After a predetermined number of rotations, the motor not shown, is reversed to rotate in a counter clockwise direction, thus causing the left sucker rod string 4 to move in a upward direction 19. As the left sucker rod string 4 is pulled in an upward direction it pulls up fluid out of the ground, however the right sucker rod string 6 acts as a counter weight for the left sucker rod string so therefore all that the drive sprocket 15 is required to pull is the head of fluid and some friction between the left sucker rod string 4 and the production tubing 20 further down into the left well 5 thus realizing a great savings of energy.

Figure 8:
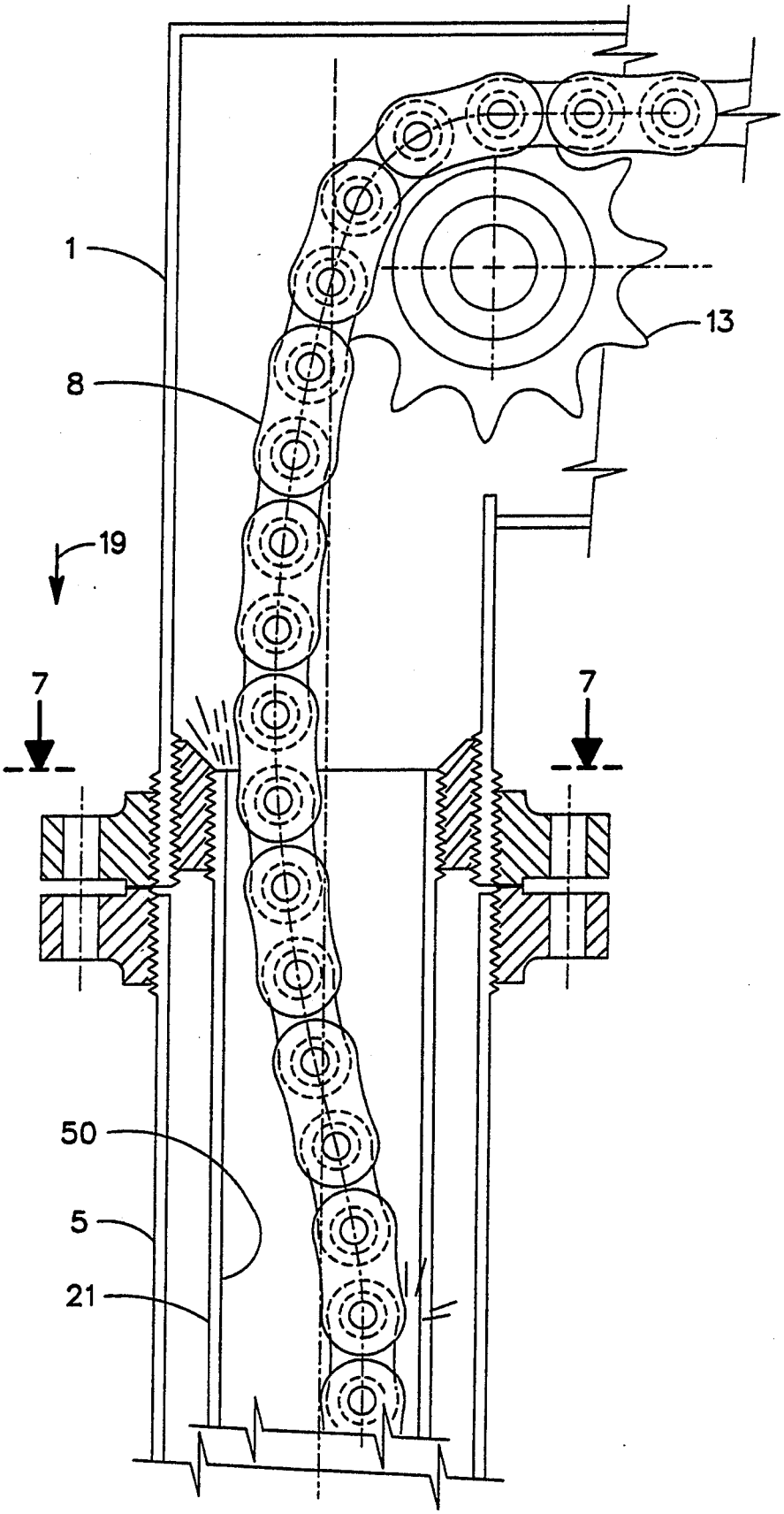
FIGURE 8 PRIOR ART
FIG. 8 is an enlarged section elevation of the upper section of the pumps without the device of the preferred embodiment.

As the mechanical chain 8 bends over the first idler sprocket 13 and moves down, the weight of the mechanical chain 8 combined with the horizontal momentum causes the chain to move horizontally and vertically thus combining to form an arc. The mechanical chain 8 must be protected from chemicals, minerals, and general debris contained in the fluid and is therefore protected inside of the pump casing 21. The diameter of the pump casing 21 is restricted by the narrow diameter of the well casing 22 which must have in pump casing annulus 23 of sufficient size to carry a sufficient quantity of fluid into the fluid outlet 24. The mechanical chain 8 is generally large and has just enough space to fit into the pump casing 21. As the mechanical chain 8 rolls off of the first idler sprocket 13 moving in a downward direction 18 and forming an arch the mechanical chain 8 will rub the pump casing 21 as shown in FIG. 8 and damage the pump casing 21.

To prevent the mechanical chain 8 from rubbing and damaging the pump casing 21 an adjustment guide rod 2 is placed near the first side of the mechanical chain 54 so that it will touch only the rollers of the mechanical chain 8 and the rollers of the mechanical chain 8 will only roll on the adjustment guide rod 2. A fixed guide rod 3 is shown on the second side of the mechanical chain 55.

The adjustment guide rod 2 is shown with a first end being rotatably fixed to the pump cover 26 and the second end being fixed to a long pinnion gear 27 at the first end of the long pinnion gear 27. The long pinnion gear 27 is further rotatably fixed at the second end of the long pinnion gear 27 to first end of the left stuffing box 10.

The long pinnion gear 27 is shown engaged with a short pinnion gear 28. The short pinnion gear 28 is shown with a first side and a second side. The second side of the short pinnion gear 28 is shown fixed to a stuffing box compression tube 29 at the first end of the stuffing box compression tube 29. The second end of the stuffing box compression tube is shown compressing the compression ring 30 at the top of the stuffing box gland 11. The long pinnion gear 27, the short pinnion gear 28, and the stuffing box compression tube will be further explained in FIG. 3.

The fixed guide rod 3 is shown suitably fixed to the pump casing by a bracket 33 near the first end of the fixed guide rod 3. The fixed guide rod 3 is also shown suitably fixed to the first end of the left stuffing box 10 at the second end of the fixed guide rod.

The fixed guide rod 3 is located near the second side of the mechanical chain 55 to further prevent the mechanical chain 8 from rebounding off of the adjustment guide rod 2 and hitting the pump casing 21. The combination of the adjustment guide rod 2 and the fixed guide rod 3 will prevent cordelle action on the mechanical chain 8.

The pump casing 21 is shown supported on the well casing 22 by a pipe hanger 25. In FIG. 1, the pipe hanger 25 is threaded to the well casing 22 and the pump casing 21, but it could be welded or flanged or fixed in another suitable means by design choice.

As the left sucker rod string 9 moves in an upward direction 19 it pulls fluid in the tubing annulus 31 and through the manifold 32 in the left stuffing box and into the pump casing annulus 23 and out of the fluid outlet 24.

Figure 2:
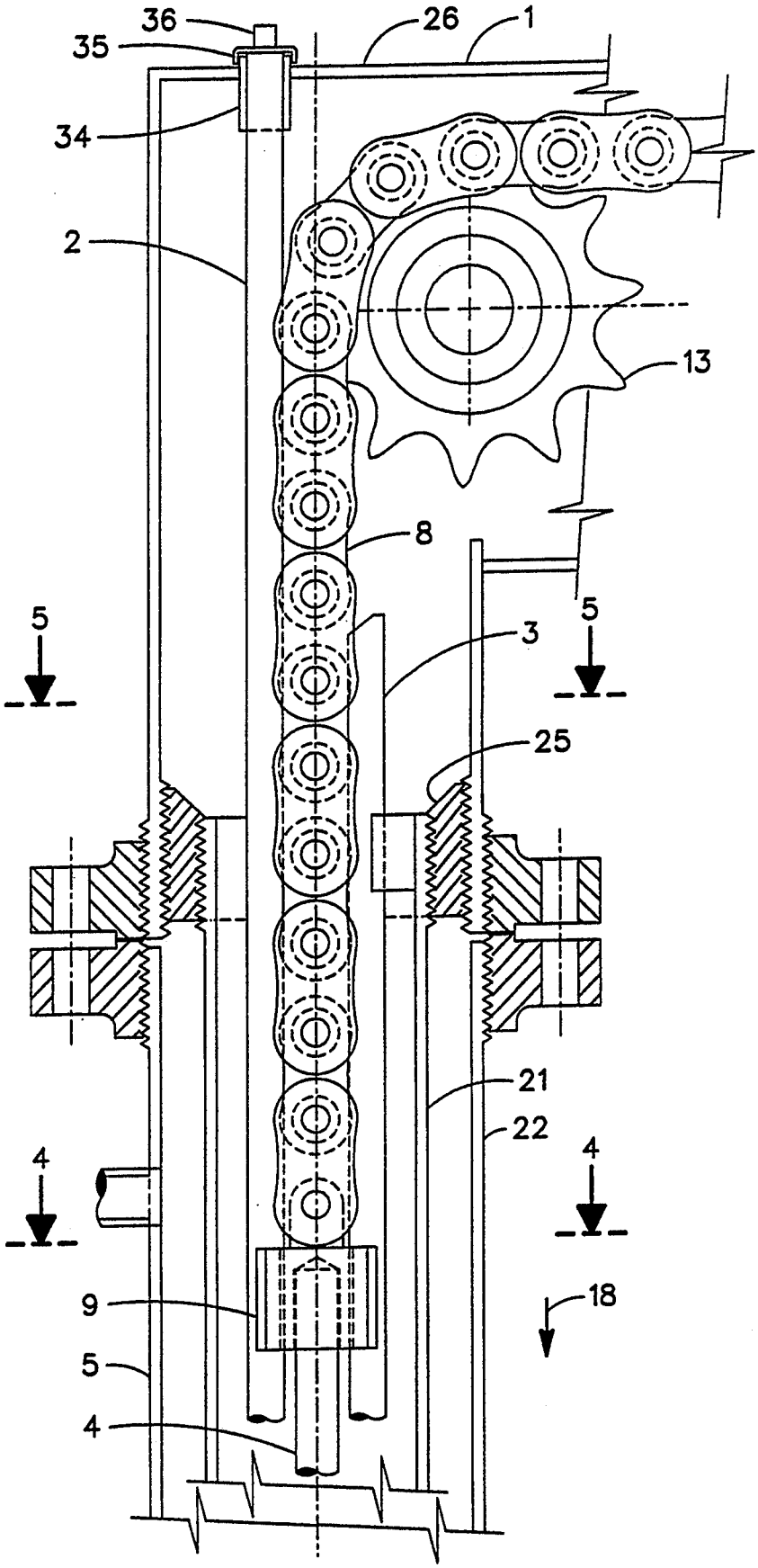
FIG. 2 is an enlarged section elevation of the upper section of the pump.

Referring to FIG. 2 there is shown an enlarged section elevation of the upper end of the two well counter balanced pump 1 and the upper part of the left well 5.

The mechanical chain 8 is shown bending over the first idler sprocket 13 and is further moving in a downward direction 18. The mechanical chain 8 is further shown between the adjusting guide rod 2 and the fixed guide rod 3. The second end of the mechanical chain 8 is shown fixed to the first end of the guide coupling 9. The first end of the left sucker rod string 4 is further shown fixed to the second end of the guide coupling 9.

The pump casing 21 is shown supported on the well casing 22 by the pipe hanger 25.

The first end of the adjusting guide rod 2 is shown supported in place by the adjusting guide rod tube 34 that acts as a bearing and allows the adjusting guide rod 2 to be rotated within the adjusting guide rod tube 34. The adjusting guide rod tube 34 is fixed to the pump cover 26 by welding or other suitable means. Also shown above the adjusting guide rod tube 34 is a cap 35 to keep rain or dust out of the two well counter balanced pump. A wrench flat extension 36 is also shown suitably fixed to the first end of the adjusting guide rod 2. The wrench flat extension 36 will allow a wrench not shown to be placed on the wrench flat extension 36 to turn or rotate the adjusting guide rod 2 that will rotate the long pinnion gear.

Figure 3:
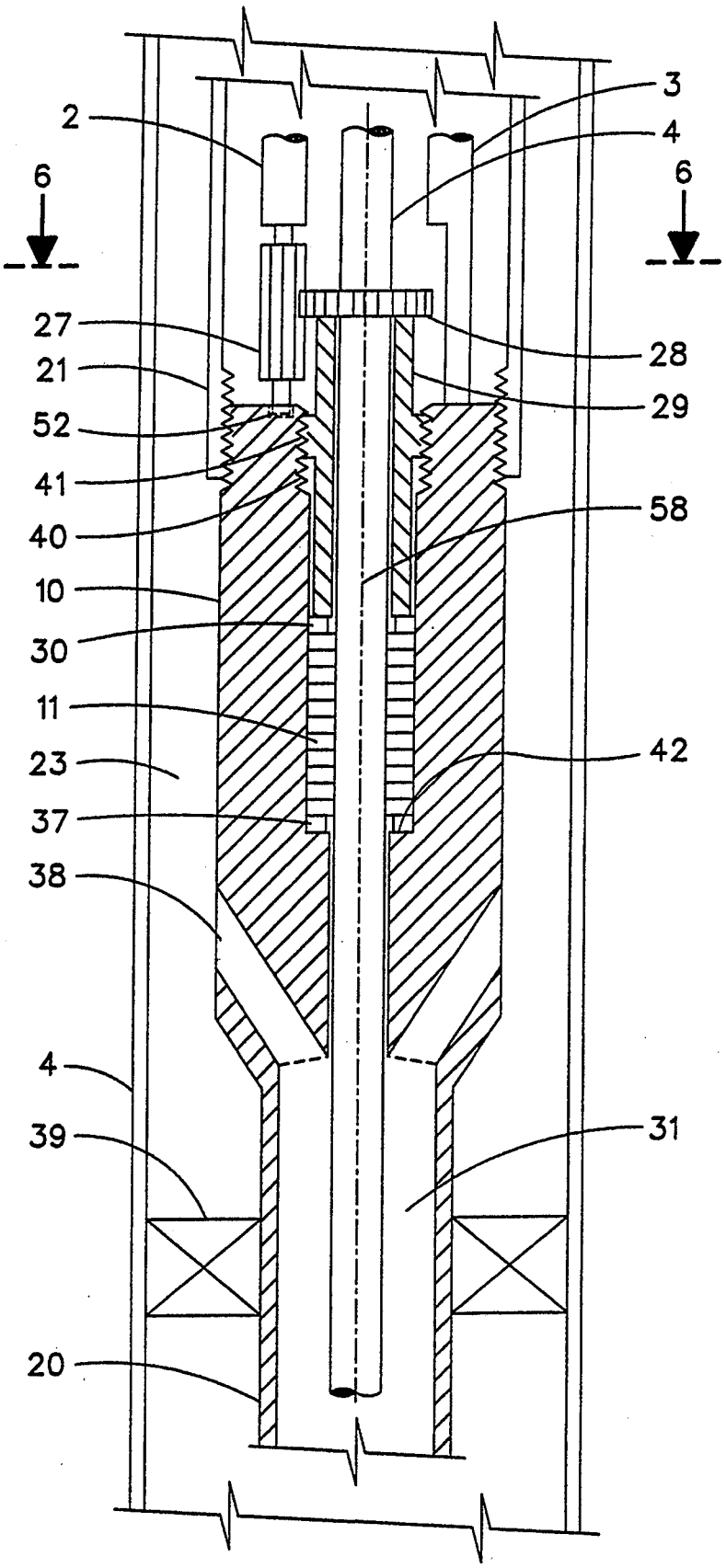
FIG. 3 is an enlarged section elevation of the lower section of the pump.

Referring to FIG. 3 there is shown an enlarged section elevation of the lower section of the pump, showing the apparatus or device in greater detail. The pump casing center axis 58 is common to and is shown in the center of the left sucker rod string 4, extending through the center of the short pinnion gear 28, the stuffing box compression tube 29, the gland 11 and the stuffing box 10.

The second end of the adjusting guide rod 2 is shown suitably fixed to the long pinnion gear 27 at the first end of the long pinnion gear 27. The second end of the long pinnion gear 27 is shown inserted into a socket 52 formed in the first end of the left stuffing box 10, that will allow the long pinnion gear 27 to rotate but will prevent the long pinnion gear 27 from moving laterally.

The long pinnion gear 27 is shown meshing with the short pinnion gear 28; when the long pinnion gear 27 is rotated, it will cause the short pinnion gear 28 to rotate in the opposite direction. The second side of the short pinnion gear 28 is suitably fixed to the first end of the stuffing box compression tube 29. The stuffing box compression tube 29 has a hole formed inside forming a hollow cylinder and has outer threads 41 formed or suitably fixed between the first end and the second end of the stuffing box compression tube 29. A first compression ring 30 is shown at the first end of the gland 11 and a second compression ring 37 is shown at the second end of the gland 11. The compression rings may not always be necessary and the gland 11 can rest directly on the inner shoulder 42. The first compression ring 30 and the second compression ring 37 are made of metal, plastic or other suitable material and acts as retaining washers to retain the gland 11 as it is compressed, and further prevent the gland 11 from wearing as the stuffing box compression tube 29 rotates and compresses.

The stuffing box 10 is shown suitably fixed to the second end of the pump casing 21 by a threaded connection or other suitable means at the first end of the stuffing box 10. At the second end of the stuffing box 10 is the manifold 38. The manifold 38 allows the fluid to move from the tubing annulus 31 into the pump casing annulus 23. The manifold 38 has at least one hole formed in the second end of the stuffing box 10. The manifold 38 extends from the tubing annulus 31 to the pump casing annulus 23, and allows fluid to flow from the tubing annulus 31 into the pump casing annulus 23. Below the manifold 38, the stuffing box is shown fixed to the production tubing 20 by welding or a threaded connection by design choice. Also shown below the manifold 38 is the packer 39 which prevents the fluid from flowing through the manifold and back down into the well.

There is a hole formed on the inside of the stuffing box 10 that extends from the first end of the stuffing box 10 to the second end of the stuffing box 10. A inner thread 40 is formed in the first end of the hole and extends towards the second end of the hole. The inner thread 40 is the same as the outer thread 41 that is on the stuffing box compression tube 29. Below the inner thread 40 the hole formed in the stuffing box is constant in diameter until it forms into an inner shoulder 42 that supports a second compression ring 43.

The fixed guide rod 3 is shown suitably fixed to the first end of the stuffing box at the second end of the fixed guide rod 3.

As the adjusting guide rod 2 is rotated, the long pinnion gear 27 fixed to the adjusting guide rod 2 also rotates in the same direction wherein the long pinnion gear 27 is engaged with the short pinnion gear 28 thus causing the short pinnion gear 28 to rotate in a direction opposite the long pinnion gear 27. The short pinnion gear 28 is further fixed to the stuffing box compression tube 29 which also rotates within the stuffing box 10. The outer threads 41 fixed to the stuffing box compression tube 29 are engaged or meshed with the inner threads 40 that are integral with the hole formed in the stuffing box 10.

As the stuffing box compression tube 29 rotates, it is forced to move up or down by the threads reacting against each other thus if the stuffing box compression tube 29 is rotated in the proper direction, it will push down on the first compression ring 30 which will compress the gland 11 forcing the gland 11 to push outward against the sides of the hole formed in the stuffing box 10 and the gland will further push inward against the left sucker rod string 4 that extends through the stuffing box 10, thus causing the gland 11 to form a liquid and gas tight seal between the hole formed in the stuffing box and the left sucker rod string 4 while allowing the left sucker rod string 4 to move up and down.

Figure 4:
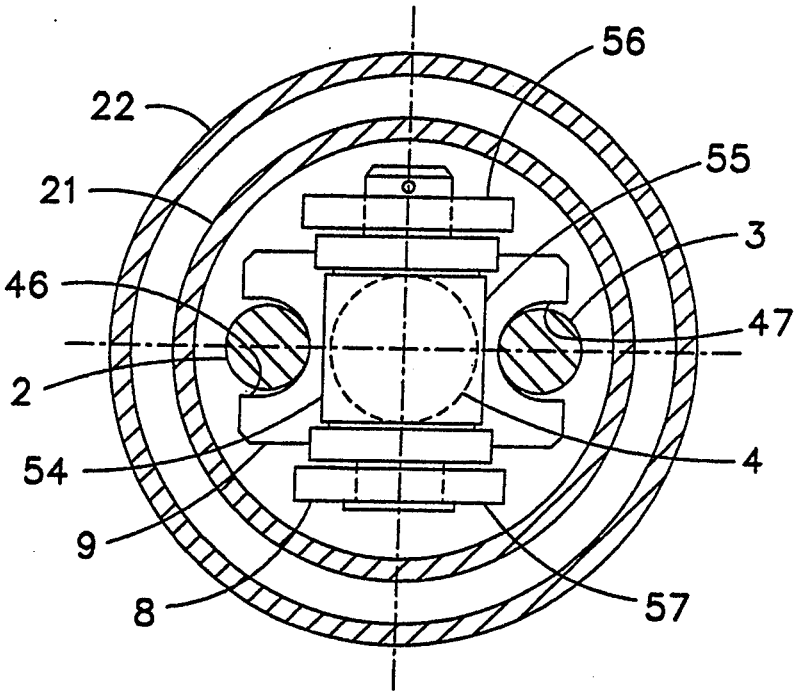
FIG. 4 is a section as taken through FIG. 2.

Referring to FIG. 4 there is shown a section view of the pump casing 21, the well casing 22, the adjusting guide rod 2, the fixed guide rod 3, the mechanical chain 8 and the guide coupling as taken through FIG. 2. The mechanical chain 8 is shown with a first side of the mechanical chain 54, the second side of the mechanical 55, the third side of the mechanical chain 56 and the fourth side of mechanical chain 57.

The guide coupling 9 has guides formed on the first side and the second side. The guide on the first side is the first guide 46 and forms a semi-circle around the adjusting guide rod 2. The guide on the second side is the second guide 47 and forms a semi-circle around the fixed guide rod 3. The first guide 46 and the second guide 47 move up and down on the fixed guide rod 3 and the adjusting guide rod 2 as the mechanical chain 8 and the sucker rod string 4 moves up and down.

As the sucker rod string 4 moves up and down in deviated or sloping well, the sucker rod string can develop torque and try to rotate. If the torque gets into the mechanical chain 8, it can cause the chain to pull off of the sprocket and cause the whole pump to fail. The guide coupling 9 with the first guide 46 on the adjusting guide rod 2 and the second guide 47 on the fixed guide rod 3, prevent the torque from going into the mechanical chain 8. Both the adjusting guide rod 2 and the fixed guide rod 3 are fixed at the first end and the second end, thus preventing the guide coupling 9 from rotating and thus prevent torque from the sucker rod string from going into the mechanical chain 8.

Figure 5:
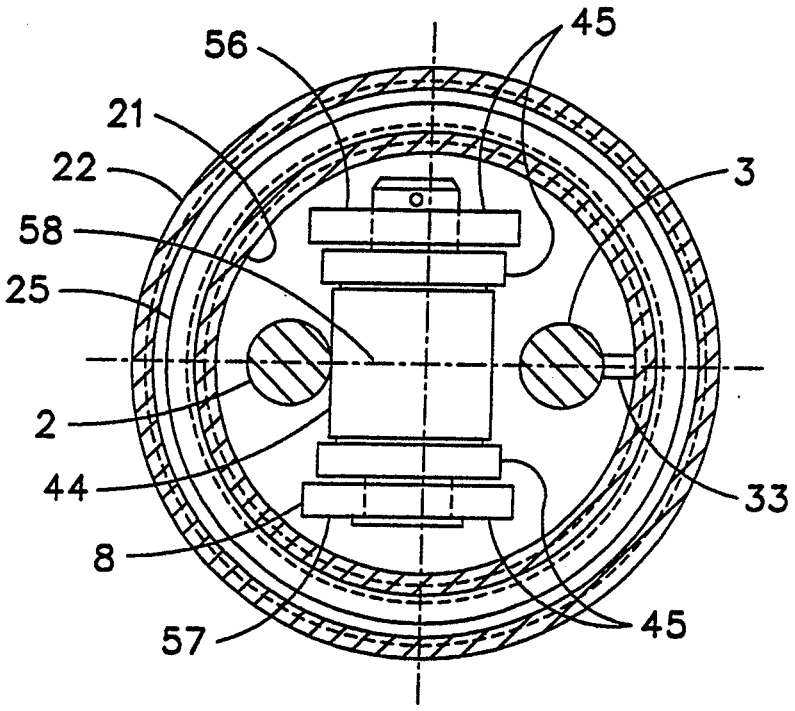
FIG. 5 is a section as taken through FIG. 2.

Referring to FIG. 5 there is shown a section view as taken through FIG. 2. The well casing 22 is shown on the outside. The pump casing 21 is shown supported on the well casing 22 by the pipe hanger 25. The pump casing 21 is a hollow robe with the mechanical chain 8 disposed inside. The pump casing is shown with a pump casing center axis 58 located in the center of the pump casing and extends from the first end of the pump casing to the second end of the pump casing 21. The fixed guide rod 3 is shown suitably supported on the bracket 33 by welding or other suitable means. The bracket 33 is shown fixed to the pump casing 21 also by welding or other suitable means.

Figure 7:
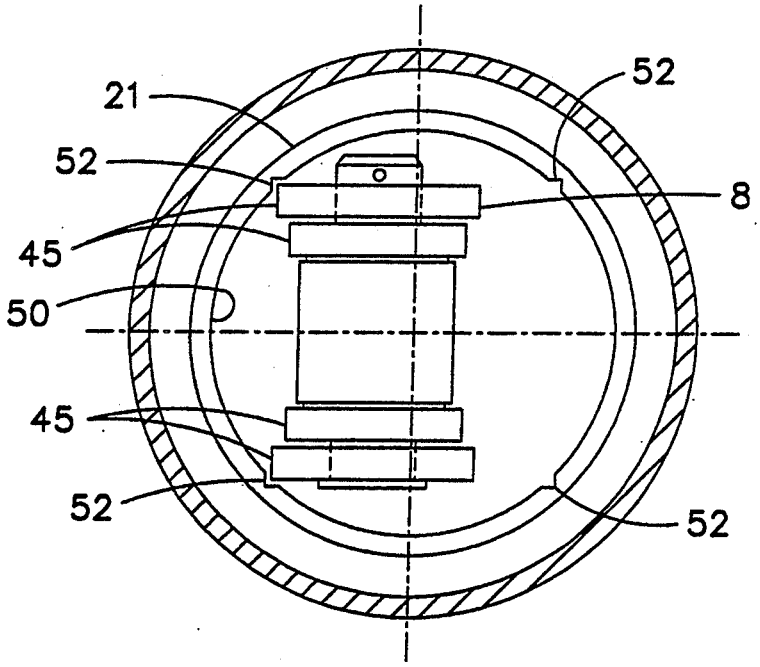
FIGURE 7 PRIOR ART
FIG. 7 is a section as taken through FIG. 8.

A roller 44 on the mechanical chain 8 is shown rolling on the adjusting guide rod 2. The roller 44 rolling or touching the adjusting guide rod 2 is the result of cordelle action or arcing of the roller chain as it moves downward at a rapid rate. The link plates 45 is shown on the third side of the mechanical chain 56, and the fourth side of the mechanical chain 57, would rub against the pump casing 21 if the adjustment guide rod 2 were not in place as shown in FIG. 7. The adjustment guide rod 2 and the fixed guide rod 3 are shown centered on the pump casing center axis 58.

If the mechanical chain 8 rebounds off of the adjusting guide rod 2 the roller 44 would touch or roll on the fixed guide rod 3 thus preventing any damage to the other side of the pump casing 21 or the link plates 45 located on the third side of the mechanical chain 56 and the fourth side of the mechanical chain 57.

Figure 6:
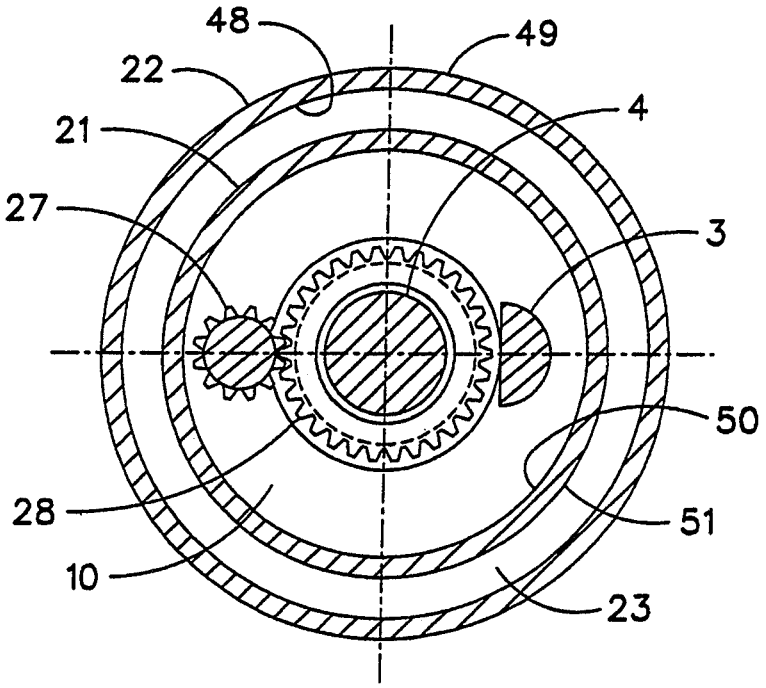
FIG. 6 is a section as taken through FIG. 3.

Referring to FIG. 6 there is shown a section view taken through FIG. 3.

The long pinnion gear 27 is shown meshed with the short pinnion gear 28. When the long pinnion gear 27 is rotated, it will rotate the short pinnion gear 28 in the opposite direction. The lift sucker rod 4 is shown extending through a hole formed in the center of the short pinnion gear 28.

The long pinnion gear is further shown rotatably fixed to the first end of the stuffing box 10. The second end of the fixed guide rod 3 is shown suitably fixed to the first end of the stuffing box 10.

The second end of the pump casing 21 is shown fixed to the first end of the stuffing box 10. The well casing 22 is shown on the outer periphery. The well casing 22 is further shown with a well casing inner surface 48 and a well casing outer surface 49. The pump casing 21 also has a pump casing inner surface 50 and a pump casing outer surface 51. The pump casing annulus 23 is shown defined or formed by the well casing inner surface 48 and the pump casing outer surface 51.

Referring to FIG. 7 there is shown a section taken through FIG. 8.

If the fixed guide rod 3 and the adjustment guide rod 2 were not in place, the link plates 45 of the mechanical chain 8 would rub on the pump casing inner surface 50 causing notches 52 or grooves to form in the pump casing 21 which would eventually destroy the pump casing 21 and allow the fluid containing sand, debris, chemicals or other undesirable materials to get into the mechanical chain 8, or cause other damage to the sprockets, bearings or other parts of the pump.

Referring to FIG. 8 there is shown a section elevation of the upper end of the two well counter balanced pump 1, and the upper part of the left well 5.

The adjusting guide rod and the fixed guide rod are not in place thereby allowing the mechanical chain 8 to arch or have a cordelle action as the mechanical chain 8 bends around the first idler sprocket 13 as it moves in a downward direction 19. As the mechanical chain 8 arches, it will rub the inner pump casing inner surface 50 and cause damage to the pump casing 21 as shown in FIG. 7.

Although the system described in detail supra has been found to be most satisfactory and preferred, many variations are possible. For example, some or all of the casing can be square casing, the mechanical chain can be a link chain, the sucker rod string can be square or oval in shape, the sprockets can be rollers or the mechanical chain can also be a belt.

Although the invention has been described with reference to the preferred embodiment it will be understood by those skilled in the art that additions, modifications, substitutions, deletions and other changes not specifically described, may be made in the embodiments herein, it should be understood that the details herein are to be interpreted illustrative and are not in a limiting sense.

What is claimed as the invention is:

1. An apparatus for use in a mechanical chain driven sucker rod pump having at least one sucker rod, for relieving cordelle action or arching action in the chain while the chain is bending over a sprocket or roller and moving from one direction into another direction comprising;

at least one sprocket wherein said sprocket rotates around an axis;

at least one mechanical chain with a first end and a second end and with a first side, a second side, a third side and a fourth side, and further having at least one link plate on said third side and at least one link plate on said fourth side and further having at least one roller, said roller extending from said first side to said second side of said mechanical chain, and wherein said roller is further located between each of said link plates and wherein said mechanical chain bends over said sprocket and said mechanical chain further has a center axis located between said link plates;

at least one coupling wherein said coupling has first end and a second end and said coupling is further fixed to said second end of said mechanical chain at said first end of said coupling;

at least one sucker rod string, wherein said sucker rod string has a first end and a second end and wherein said first end of said sucker rod string is fixed to said second end of said coupling;

at least one pump casing, wherein said pump casing has a first end and a second end and wherein said casing is a hollow tube with a center axis and wherein said mechanical chain, said coupling and said sucker rod disposed inside of said casing;

at least one guide rod, said first guide rod having a first end and a second end and wherein said guide rod is fixed near said first end of said pump casing and said guide rod is fixed near the second end of said pump casing and said guide rod is located near the center axis of said pump casing and said guide rod is further located near said roller and on the center axis of said mechanical chain wherein as said mechanical chain is moving off of said sprocket at a rapid rate, said mechanical chain will bend around said sprocket and will move in the direction of said sucker rod string but the momentum of said chain will also cause said chain to move in the same direction that it was moving in prior to bending around the said sprocket wherein the said rollers of said chain will roll on said guide rod thus preventing said chain from arching within said casing and further preventing said casing from being damaged by said link plate of said chain.

2. The apparatus of claim 1 wherein said apparatus further includes a second guide rod, wherein said second guide rod is located near said second side of said mechanical chain and wherein said second guide rod has a first end and a second end and wherein said second guide rod is fixed to said casing at said second end of said second guide rod.

3. The apparatus of claim 1 wherein said guide rod is round.

4. The apparatus of claim 1 wherein said guide rod is square.

5. The apparatus of claim 1 wherein said first guide rod can rotate.

6. An apparatus for use in a mechanical chain driven sucker rod pump having a mechanical chain and at least one torque induced sucker rod, wherein sucker rod torque and twisting of said mechanical chain are prevented, comprising:

at least one sprocket wherein said sprocket rotates around an axis;

at least one mechanical chain with a first end and a second end and with a first side and a second side, and further having at least one link plate on said first side and at least one link plate on said second side and further having at least one roller between each of said link plates and wherein said mechanical chain bends over said sprocket and wherein said mechanical chain further has a center axis located between said link plates, and said mechanical chain has a third side and a fourth side;

at least one casing, wherein said casing has a first end and a second end wherein said casing is a hollow tube and wherein said mechanical chain is disposed inside of said casing and said casing is further fixed to said pump at said first end of said casing;

at least one first guide rod, said first guide rod having a first end and a second end and wherein said first guide rod is disposed within said casing near said mechanical chain and further said first guide rod is fixed to said casing or said mechanical chain driven sucker pump and wherein said second end of said first guide rod is fixed to said second end of said casing and wherein said first guide rod is round in section;

at least one second guide rod, said second guide rod having a first end and a second end and wherein said second guide rod is disposed within said casing on the opposite side of said mechanical chain as said first guide rod and wherein said second guide rod is fixed at the first said end of second guide rod to said first end of said casing and said second guide rod is further fixed to said second end of said casing at said second end of said second guide rod and wherein said second guide rod is round in section;

a guide coupling wherein said guide coupling has a first end and a second end and a first side and a second side and wherein said guide coupling is fixed to said second end of said mechanical chain at said first end of said guide coupling and further said guide coupling is fixed to said first end of said sucker rod string at said second end of said guide coupling and wherein said guide coupling has a first guide on the first side of said guide coupling and a second guide on the second side of said guide coupling and wherein said first guide is formed to be partially disposed around said first guide rod and said second guide is formed to be partially disposed around second guide rod and wherein when said mechanical chain pulls up on said sucker rod string with torque in said sucker rod string wherein said torque cannot be transmitted into said mechanical chain because said first guide is disposed on said first guide rod fixed to said casing and said second guide is further disposed on said second guide rod fixed to said casing thereby not allowing said sucker rod torque to be transmitted into the mechanical chain.

7. The apparatus of chain 6 wherein said first guide rod can rotate.

8. The apparatus of chain 6 wherein said first guide rod may be square in section.

9. The apparatus of chain 6 wherein a stuffing box is fixed to said second end of said casing.

10. The apparatus of chain 6 wherein said casing is further disposed within a well casing.

11. An apparatus for use in a mechanical chain driven sucker rod pump having at least one sucker rod string, for adjusting and compressing a gland contained in a stuffing box below the wellhead of a well comprising:

at least one sprocket wherein said sprocket rotates around an axis;

at least one mechanical chain with a first end and a second end and with a first side and a second side and further having at least one first link plate on said first side and further having at least one second link plate on said second side and further having at least one roller between said first link plate and said second link plate and wherein said mechanical chain further has a center axis between said first link plate and said second link plate and wherein said axis is perpendicular to said roller, and wherein said mechanical chain moves up and down in said well;

a pump cover that covers said pump;

at least one sucker rod string with a first end and a second end and wherein said first end of said sucker rod string is fixed to said second end of said mechanical chain and said sucker rod string moves up and down in a line with said mechanical chain;

at least one casing with a first end and a second end wherein said casing is a hollow tube and said mechanical chain and said sucker rod string is disposed within said casing and is fixed to said wellhead at said first end of said casing;

a stuffing box wherein said stuffing box has a first end and a second end and wherein said stuffing box has a hole formed in the center of said stuffing box and wherein said hole formed in said stuffing box has a first end and a second end and inner threads are formed in said hole near said first end and an inner shoulder is formed essentially below said inner threads and wherein said first end of said stuffing box is fixed to said second end of said casing;

an adjusting guide rod with a first end and second end wherein said adjusting guide rod is rotatably fixed to said pump cover at said first end of said guide rod wherein said guide rod can be rotated;

a long pinnion gear with a first end and a second end wherein said first end of said long pinnion gear is fixed to said second end of said adjusting guide rod and said second end of said long pinnion gear is rotatably fixed to said first end of said stuffing box wherein said long pinnion gear can rotate;

a short pinnion gear wherein said short pinnion gear has a first side and a second side and said short pinnion gear has a hole formed on the inside to suitably allow the said sucker rod string to pass unobstructed;

a stuffing box compression tube that is round with a first end and a second end wherein said stuffing box compression tube has a center axis that extends from said first end to said second end wherein a hole is formed along said center axis of said stuffing box compression tube and wherein said hole extends from said first end through said second end of said stuffing box compression tube and wherein said hole is larger in diameter than said sucker rod string to allow said sucker rod string to easily pass through said hole in said stuffing box compression tube and further said stuffing box compression tube has an outer periphery with outer threads on said outer periphery said outer threads are between said first end of said stuffing box compression tube and said second end of said stuffing box compression tube and wherein said first end of said stuffing box compression tube is suitably fixed to said second side of said short pinnion gear and said second end of said stuffing box compression tube is inserted into said hole of said stuffing box and further said outer threads of said stuffing box compression tube mesh and are engaged with said inner threads of said stuffing box and said short pinnion gear fixed to said first end of said stuffing box compression tube and wherein said short pinnion gear is engaged with said long pinnion gear;

a gland, said gland being made of a suitable soft material and is formed by a series of rings with a first end and a second end wherein said second end ring is set on said inner shoulder of said stuffing box and wherein other rings are stacked on said ring at said second end and wherein the said sucker rod string is disposed through said rings and said rings are further compressed between said inner shoulder and said stuffing box compression tube wherein the adjusting guide rod is rotated further rotating said long pinnion gear fixed to said adjusting guide rod and said long pinnion gear is further engaged to said short pinnion gear causing said pinnion gear to rotate in an opposite direction of said long pinnion gear and further causing said stuffing box adjusting tube that is fixed to said short pinnion gear to rotate and further causing said outer threads of said stuffing box adjusting tube that are meshed or engaged with said inner threads of said stuffing box to react against each other causing said stuffing box compression tube to compress on said first end of said gland and to further compress said second end of said gland against said inner shoulder of said stuffing box further causing said gland rings to compress inward against said sucker rod string and outward against said hole formed in said stuffing further forming a fluid tight seal between said stuffing box and said sucker rod string thus preventing debris and minerals from contaminating and destroying said mechanical chain while said mechanical chain and said sucker rod string are moving.

12. The apparatus of chain 11 wherein said gland is made out of one strip of suitable material wherein said gland is wrapped around said sucker rod string in a spiral.

13. The apparatus of chain 11 wherein said short pinnion gear engaged with said long pinnion gear moves from said first end of said long pinnion gear toward said second end of said long pinnion gear as said stuffing box compression tube compresses said gland.

14. The apparatus of chain 11 wherein said adjusting guide rod has a wrench flat fixed to said first end of said adjusting guide rod said wrench flat to further allow the placement of a wrench to turn said adjusting guide rod.

15. The apparatus of chain 11 wherein said stuffing box is a manifold formed at said second end of said stuffing box.

* * * * *